US008079871B2

(12) United States Patent
Ye

(10) Patent No.: US 8,079,871 B2
(45) Date of Patent: Dec. 20, 2011

(54) CONNECTOR ASSEMBLY FOR HEAT DISSIPATION DEVICE

(75) Inventor: Zhen-Xing Ye, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 52 days.

(21) Appl. No.: 12/829,436

(22) Filed: Jul. 2, 2010

(65) Prior Publication Data

US 2011/0189881 A1 Aug. 4, 2011

(30) Foreign Application Priority Data

Feb. 4, 2010 (CN) ..... 2010 1 0301200

(51) Int. Cl.
*H01R 13/40* (2006.01)

(52) U.S. Cl. ..... 439/596; 439/912

(58) Field of Classification Search ..... 439/467, 439/596, 731, 912
See application file for complete search history.

(56) References Cited

U.S. PATENT DOCUMENTS

| | | | | |
|---|---|---|---|---|
| 7,186,151 | B2 * | 3/2007 | Komiyama | 439/701 |
| 7,540,749 | B1 * | 6/2009 | Hall et al. | 439/135 |
| 7,556,539 | B2 * | 7/2009 | Takahashi et al. | 439/752 |

* cited by examiner

*Primary Examiner* — Khiem Nguyen
(74) *Attorney, Agent, or Firm* — Altis Law Group, Inc.

(57) ABSTRACT

A connector assembly comprises a main body and a cover rotatably connected to the main body. The main body comprises a base wall, a first sidewall, a second sidewall, and a third sidewall extending from three edges of the base wall. The base wall and the three sidewalls cooperatively define a latching groove for receiving the cover. The base wall defines a plurality of receiving slots receiving a corresponding plurality of conductive wires and communicating with the latching groove. The cover defines a plurality of mounting slots cooperating with the receiving slots of the main body for receiving a plurality of testing wires. When the cover is rotated to a predetermined position relative to the main body, the testing wires are electronically connected to the corresponding conductive wires.

11 Claims, 3 Drawing Sheets

CONNECTOR ASSEMBLY FOR HEAT DISSIPATION DEVICE

BACKGROUND

1. Technical Field

The present disclosure generally relates to connector assembly and, particularly, to a connector assembly used in a heat dissipation device.

2. Description of Related Art

With developments in technology, increased electronic component deployment in electronic devices create the need to deal with substantial heat. If the heat is not efficiently dissipated from the electronic components, stability and performance can be difficult to sustain. Commonly a heat dissipation device is applied to an electronic component to help dissipate the heat.

A commonly used heat dissipation device includes an electronic fan including a main body, a connector, and four conducting wires. Opposite ends of each conducting wire are connected to the main body and the connector, respectively. The electronic fan requires testing before operation. In one testing method, two of the conducting wires are removed from the connector and connected to a testing device. Unfortunately, the conducting wires are easily damaged during the testing method and the testing may not obtain an accurate result.

Therefore, there is room for improvement within the art.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout several views, and all the views are schematic.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
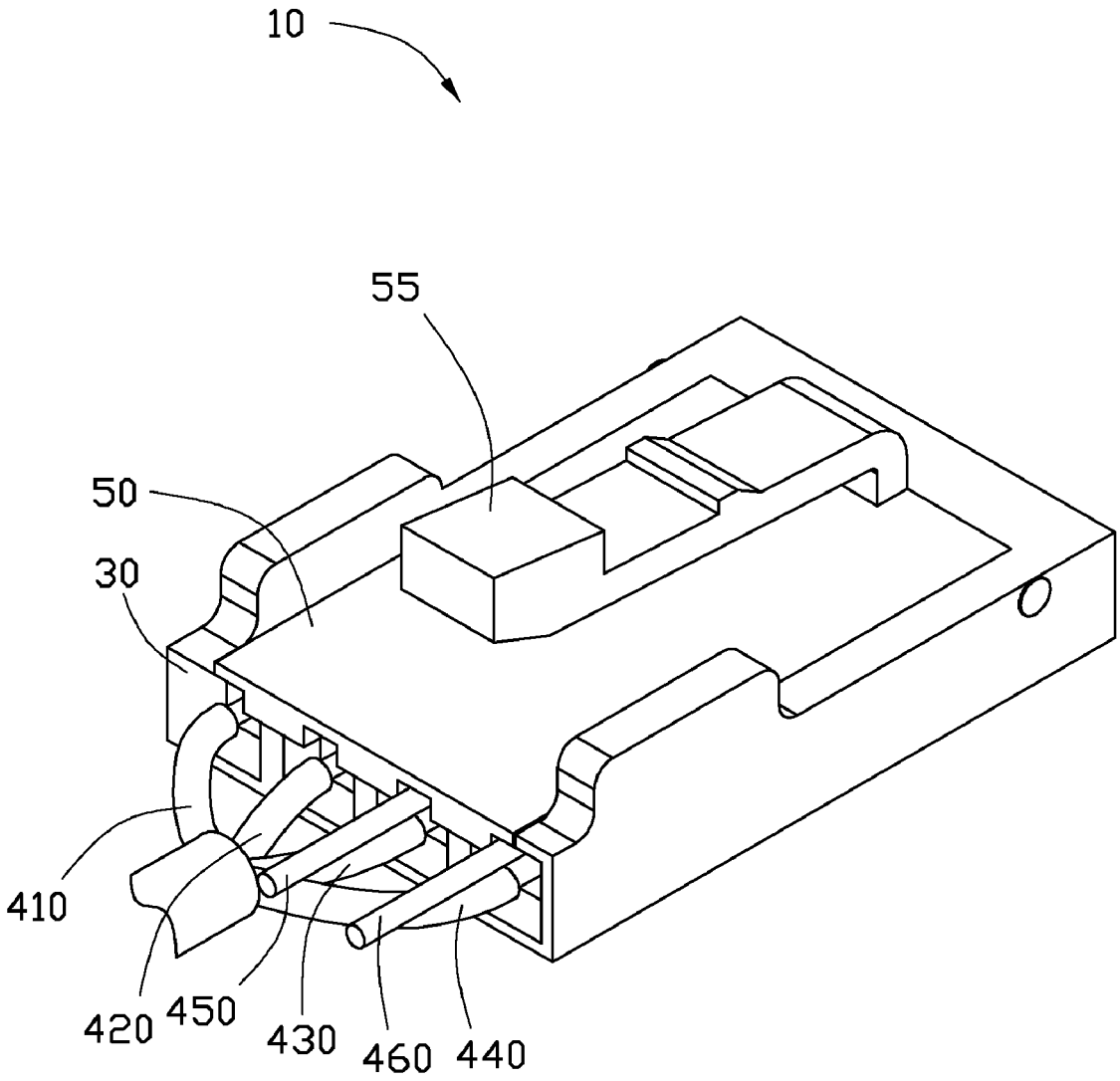
FIG. 1 is an assembled, isometric view of an embodiment of a connector assembly in a first state, the connector assembly including a main body and a cover.
Figure 2:
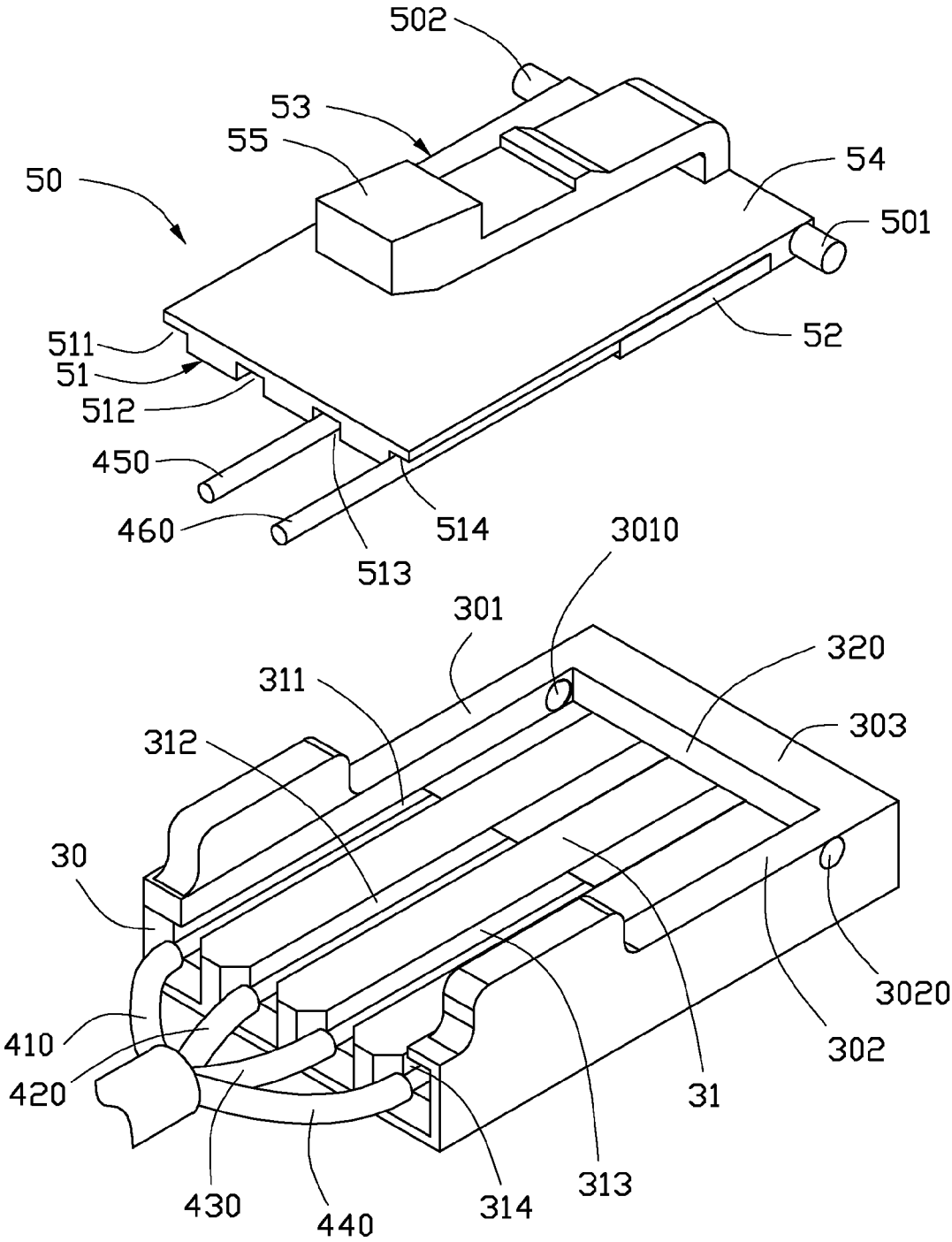
FIG. 2 is an exploded, isometric view of the connector assembly of FIG. 1.

Referring to FIGS. 1 and 2, a connector assembly 10 includes a main body 30 and a cover 50 rotatably connected to the main body 30, a first conducting wire 410, a second conducting wire 420, a third conducting wire 430, and a fourth conducting wire 440.

The main body 30 includes a base wall 31, a first sidewall 301, a second sidewall 302, and a third sidewall 303 extending from three edges of the base wall 31 of the main body 30, respectively. The first sidewall 301 is parallel to the second sidewall 302, and the third sidewall 303 is between the first and second sidewalls 301, 302. The base wall 31 and the three sidewalls 301, 302, 303 cooperatively define a latching groove 320. The main body 30 further defines a first receiving slot 311, a second receiving slot 312, a third receiving slot 313, and a fourth receiving slot 314 in the base wall 31. The first, second, third, and four receiving slots 311, 312, 313, 314 are substantially parallel and communicate with the latching groove 320. The first sidewall 301 defines a first shaft hole 3010 in an end adjacent to the sidewall 303, and the second sidewall 302 defines a second shaft hole 3020 in an end adjacent to the sidewall 303. The first shaft hole 3010 and the second shaft hole 3020 of the main body 30 are coaxial.

Figure 3:
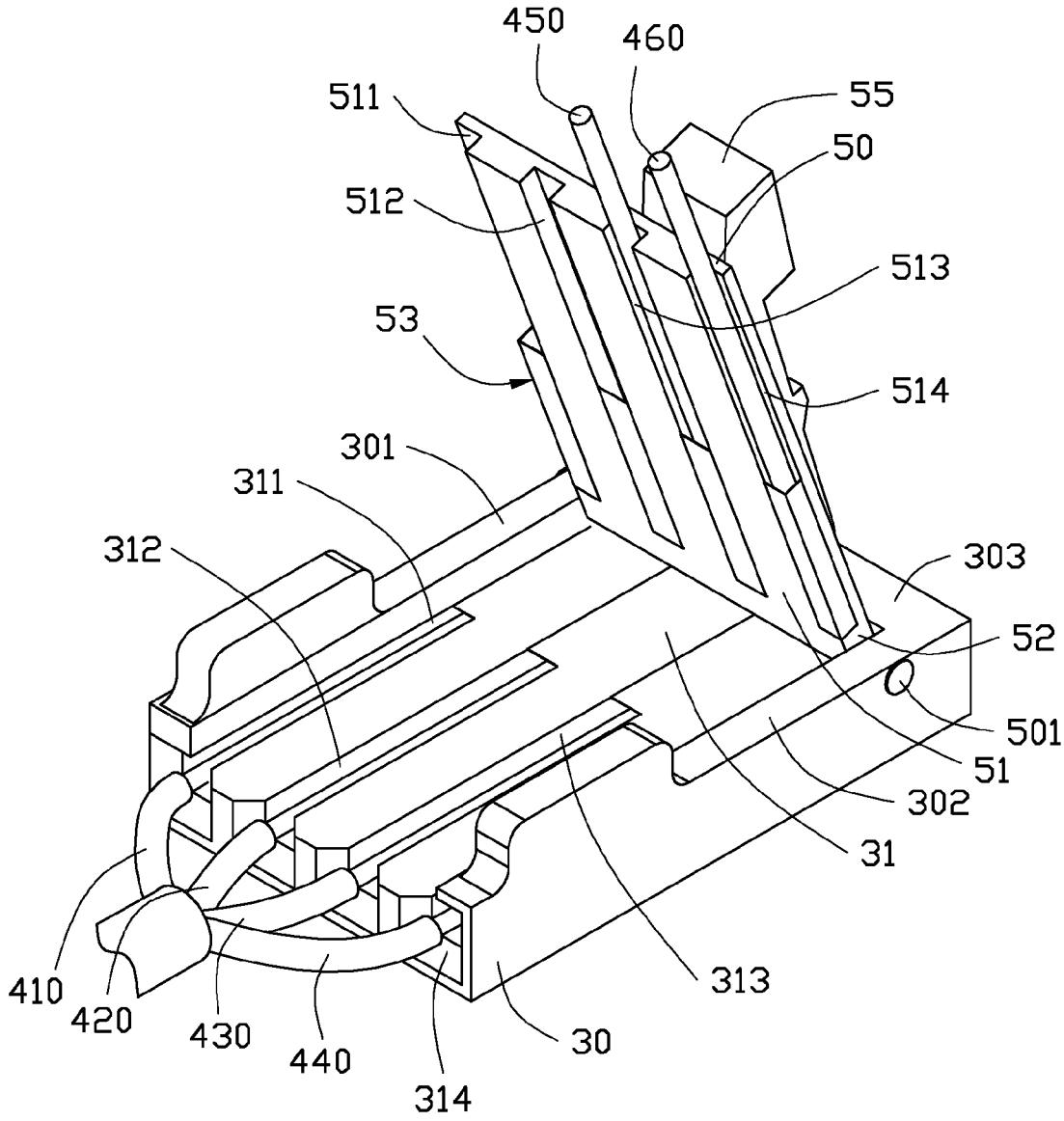
FIG. 3 shows a second state of the connector assembly of FIG. 1.

Referring to FIGS. 2 and 3, the cover 50 includes an end surface 51, a first side surface 52, a second side surface 53, an outer surface 54 opposite to the end surface 51, a first shaft 501 protruding from the first side surface 52, a second shaft 502 protruding from the second side surface 53, and a handle portion 55 protruding from the outer surface 54. The first side surface 52 and the second side surface 53 are parallel, the end surface 51 and the outer surface 54 are parallel, and the first and second side surfaces 52, 53 are arranged between the end surface 51 and the outer surface 54. The cover 50 further defines a first mounting slot 511, a second mounting slot 512, a third mounting slot 513, and a fourth mounting slot 514 from the end surface 51 into the cover 50. The four mounting slots 511, 512, 513, 514 are parallel to each other.

During assembly of the cover 50 to the main body 30, the first shaft 501 and the second shaft 502 of the cover 50 are received in the first shaft hole 3010 and the second shaft hole 3020 of the main body 30, respectively, such that cover 50 is rotatable relative to the main body 30. Width of the cover 50 exceeds that of the latching groove 320 of the main body 30. Thus, the cover 50 can be received and positioned in the latching groove 320 of the main body 30. The four mounting slots 511, 512, 513, 514 of the cover 50 correspond to the four receiving slots 311, 312, 313, 314 of the main body 30, respectively. When the cover 50 is positioned in the latching groove 320 of the main body 30, the end surface 51 of the cover 50 covers the base wall 31 of the main body 30.

During testing of the connector assembly 10, the four conductive wires 410, 420, 430, 440 are received in the four receiving slots 311, 312, 313, 314, respectively. The first conductive wire 410 is connected to the anode of a power source (not shown), the second conductive wire 420 is connected to the cathode of the power source, the third conductive wire 430 connects an electronic fan (not shown) to a testing member (not shown), and the fourth conductive wire 440 transmits a control signal to the electronic fan. A first testing wire 450 and a second testing wire 460 are received in the third mounting slot 513 and the fourth mounting slot 514 of the cover 50, respectively. Then the cover 50 is rotated and received in the latching groove 320 of the main body 30, and the first testing wire 450 and the second testing wire 460 are electrically connected to the first conductive wire 410 and the second conductive wire 420, respectively. The first and second testing wires 450, 460 are connected to the testing device and testing begins. After testing, the cover 50 can be withdrawn from the latching groove 320 of the main body 30 by the handle portion 55.

The cover 50 of the connector assembly 10 is rotatably connected to the main body 30, thus, the testing wires can be received in the cover 50 and electrically connected to the conductive wires easily and precisely. The conductive wires need not be removed from the connector assembly 10 for testing, thus preventing damaged and prolonging the service life of the conductive wires.

The number of mounting and receiving slots can be adjusted according to the number of testing wires and conductive wires. The testing wires may also be connected to the cover of the connector assembly by welding, adhesion, or other methods.

Finally, while various embodiments have been described and illustrated, the disclosure is not to be construed as being limited thereto. Various modifications can be made to the embodiments by those skilled in the art without departing from the true spirit and scope of the disclosure as defined by the appended claims.

What is claimed is:

1. A connector assembly, comprising:

a main body defining a plurality of receiving slots therein;

a plurality of conductive wires received in the corresponding plurality of receiving slots; and a cover rotatably connected to the main body and defining a plurality of mounting slots corresponding to the plurality of receiving slots for receiving a plurality of testing wires, wherein when the cover is rotated to a predetermined position relative to the main body, the plurality of testing wires is capable of being electronically connected to the corresponding plurality of conductive wires.

2. The connector assembly of claim 1, wherein the main body further defines a latching groove receiving the cover and communicating with the plurality of receiving slots.

3. The connector assembly of claim 2, wherein width of the cover exceeds that of the latching groove of the main body.

4. The connector assembly of claim 1, wherein each receiving slot of the main body faces one mounting slot of the cover.

5. The connector assembly of claim 1, wherein the cover comprises an end surface, a first side surface, and a second side surface; the first and second side surfaces are arranged on opposite sides of the end surface; the cover further comprising two shafts protruding from the first and second side surfaces respectively; the main body further defines two shaft holes, and the two shafts are rotatably received in the two shaft holes, respectively.

6. The connector assembly of claim 5, wherein the cover further comprises an outer surface opposite to the end surface and a handle portion protruding from the outer surface.

7. A connector assembly, comprising:

a main body comprising a base wall defining a plurality of receiving slots, a first sidewall, a second sidewall, and a third sidewall extending from three edges of the base wall;

a plurality of conductive wires received in the corresponding plurality of receiving slots; and a cover rotatably connected to the first and second sidewalls of the main body and defining a plurality of mounting slots corresponding to the plurality of receiving slots; and a plurality of testing wires received in the corresponding plurality of mounting slots of the cover; wherein when the cover is rotated to a predetermined position relative to the main body, the plurality of testing wires is capable of being electronically connected to the corresponding plurality of conductive wires.

8. The connector assembly of claim 7, wherein the base wall, the first sidewall, the second sidewall, and the third sidewall cooperatively define a latching groove communicating with the plurality of receiving slots of the main body for receiving the cover.

9. The connector assembly of claim 8, wherein the cover comprises an end surface, a first side surface, and a second side surface; the first side surface and the second side surface are arranged opposite sides of the end surface; the cover further comprises two shafts protruding from the first and second side surfaces respectively; the main body defines two shaft holes in the first and second sidewalls, respectively; and the two shafts are rotatably received in the two shaft holes, respectively.

10. The connector assembly of claim 9, wherein the cover further comprises an outer surface opposite to the end surface and a handle portion protruding from the outer surface.

11. A connector assembly, comprising:

a main body defining a plurality of receiving slots therein;

a plurality of conductive wires received in the corresponding plurality of receiving slots; and a cover movable relative to the main body and defining a plurality of mounting slots corresponding to the plurality of receiving slots for receiving a plurality of testing wires, wherein when the cover is moved to a first predetermined position relative to the main body, the plurality of testing wires is capable of being electronically connected to the corresponding plurality of conductive wires, and when the cover is moved to a second predetermined position relative to the main body, the plurality of testing wires is capable of being detached from the corresponding plurality of conductive wires.

* * * * *